US006431045B1

(12) United States Patent
Eken

(10) Patent No.: US 6,431,045 B1
(45) Date of Patent: Aug. 13, 2002

(54) TRIGGER SYSTEM FOR RECOIL DRIVEN WEAPONS

(75) Inventor: Oddbjorn Eken, Prestfoss (NO)

(73) Assignee: Vinghogs Mek. Verksted AS, Tonsberg (NO)

( * ) Notice: Subject to any disclaimer, the term of this patent is extended or adjusted under 35 U.S.C. 154(b) by 0 days.

(21) Appl. No.: 09/380,342

(22) PCT Filed: Mar. 13, 1998

(86) PCT No.: PCT/NO98/00084

§ 371 (c)(1),
(2), (4) Date: Nov. 15, 1999

(87) PCT Pub. No.: WO98/41808

PCT Pub. Date: Sep. 24, 1998

(30) Foreign Application Priority Data

Mar. 14, 1997 (NO) ..... 971212

(51) Int. Cl.[7] ..... F41A 5/00

(52) U.S. Cl. ..... 89/144; 89/129.01; 89/130; 89/136; 89/138

(58) Field of Search ..... 89/144, 129.01, 89/130, 136, 138

(56) References Cited

U.S. PATENT DOCUMENTS

| | | | | | |
|---|---|---|---|---|---|
| 3,846,928 | A | * | 11/1974 | Ruger et al. | 89/138 |
| 4,057,003 | A | * | 11/1977 | Atchisson | 89/138 |
| 4,391,180 | A | * | 7/1983 | Koine | 89/129.01 |
| 4,719,841 | A | * | 1/1988 | Perrine | 89/144 |
| 5,379,677 | A | * | 1/1995 | Ealovega et al. | 89/130 |

* cited by examiner

*Primary Examiner*—J. Woodrow Eldred
(74) *Attorney, Agent, or Firm*—Pitney, Hardin, Kipp & Szuch LLP

(57) ABSTRACT

A device is disclosed for a weapon for firing burst of several shots. The device unlocks and latches the rifle bolt in the rear position to avoid heat distribution from the chamber or barrel to the powder or explosives in the booster charge or the explosive projectile, and to prevent firing by emptying or handling the weapon. The activator moves the trigger into engagement with the stop flap of the rifle bolt, thereby releasing the spring force of the rifle bolt forwardly during firing only when the rifle bolt and the cover are in the locked position.

4 Claims, 1 Drawing Sheet

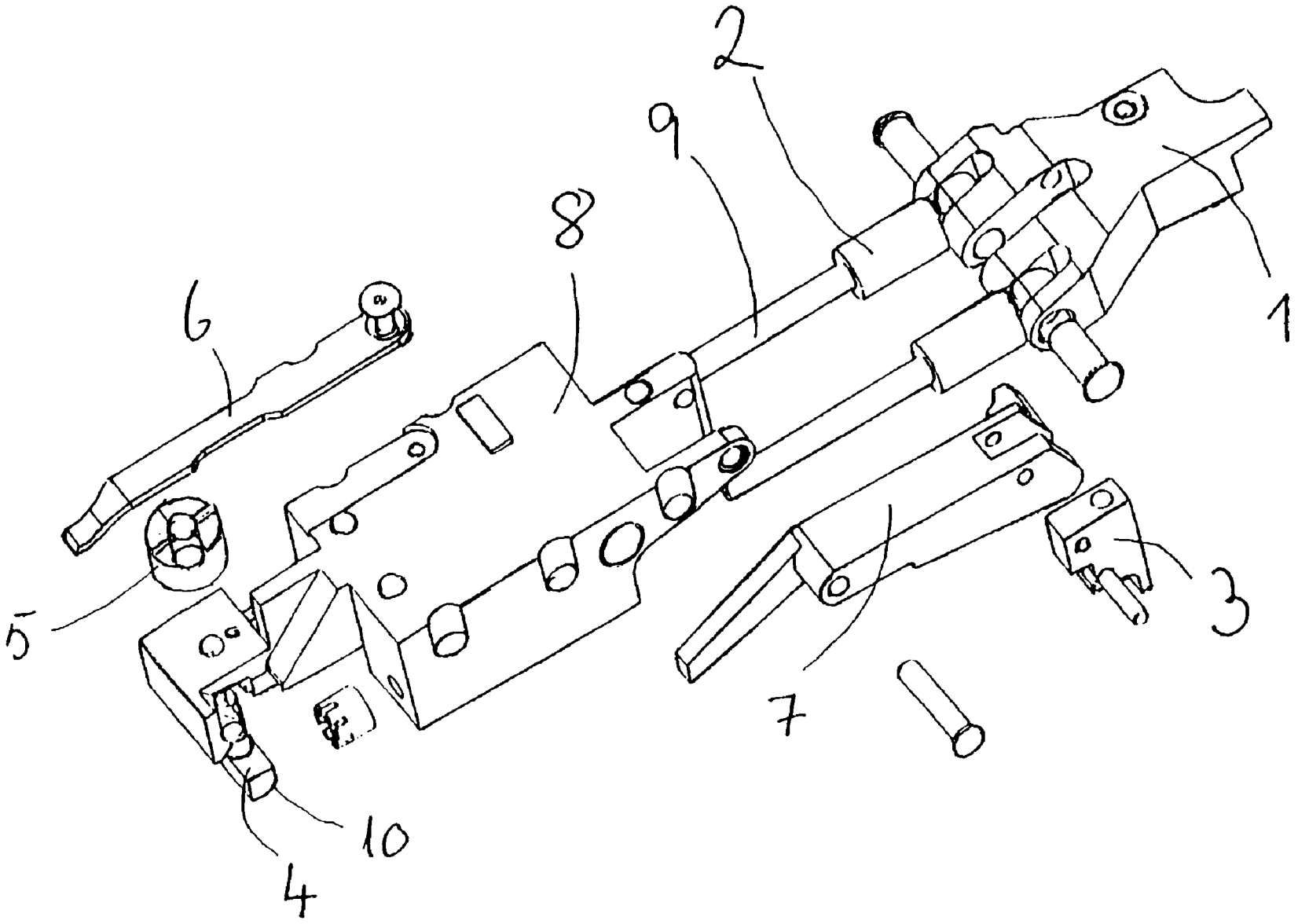
1
2
3
4
5
6
7
8
9
10

TRIGGER SYSTEM FOR RECOIL DRIVEN WEAPONS

BACKGROUND OF THE INVENTION

1. Field of the Invention

The present invention relates to a trigger system for recoil driven weapons.

2. Description of the Prior Art

Recoil driven weapons with known trigger systems are fired with a closed rifle bolt. This may cause undesired firing due to the heat in the chamber or the rifle barrel. Prior art weapons include a stop flap having two latching grooves in the rifle bolt to latch the rifle bolt in the rear position. The stop flap normally is suspended in a buffer on one side and is therefore subject to asymmetric load.

OBJECTS AND SUMMARY OF THE INVENTION

It is an object of the present invention to provide a trigger system which is secure against undesired firing due to heat in the chamber or the rifle barrel.

This and other objects are achieved by providing a trigger system according to the present invention wherein the trigger system fires the weapon with an open rifle bolt. This means that there is no longer a cartridge in the chamber. Further, the trigger system of the present invention introduces several safety devices into the weapon.

DESCRIPTION OF THE DRAWINGS

Further objects and advantages of the invention will become apparent from the following description and claims, and from the accompanying drawing, wherein:

FIG. 1 is an exploded perspective view of the trigger system of the present invention.

DETAILED DESCRIPTION OF THE PREFERRED EMBODIMENT

Referring now to the drawing in detail, one sees that the trigger system according to the present invention includes a stop flap 1 suspended in two buffers 2, thereby establishing a symmetric system. The stop flap 1 of the buffers absorbs the force of the rifle bolt.

The stop flap 1 is activated by the movement of trigger 3 which is journalled for rotation on trigger arm 7. The trigger arm 7 is journalled for rotation in housing 8 and the stop flap 1 is likewise journalled for rotation in the housing 8 with bolts 9 and buffers 2 therebetween.

The trigger arm 7 ensures that the stop flap 1 has a first position and a second position, the first position is disengaged thereby allowing free movement of the rifle bolt resulting in fully automatic operation. In the second position, there is maximum engagement with the hooking groove of the rifle bolt, thereby locking the rifle bolt in the rear position.

Trigger 3 is constructed and arranged such that when the trigger 3 is held in the firing position, trigger 3 is in locked engagement with the stop flap 1 thereby ensuring that the firing will not be interrupted in the fully automatic mode. When the trigger is released, the rear edge of the rifle bolt hits the trigger 3 forcing the trigger 3 out of engagement with the stop flap 1. The stop flap is thereby latched into engagement with the rifle bolt which is latched in the rear position.

Firing is initiated by releasing the firing pin by the trigger hook, the guide 4 for the trigger hook thereby being pressed downwardly. The inclined surface 10 on the trigger hook guide 4 is also used to adjust the firing time with relation to the position of the rifle bolt. This adjustment is performed by an adjustment wheel adjusting the height of the inclined surface 10 and thereby adjusting the position of the rifle bolt at the time of firing.

The locking device 6 for the trigger ensures that firing is not possible when the cover of the weapon is open. The locking device is arranged in front of the stop flap 1 lock. The locking device is pressed down by the cover and brings the trigger hook guide 4 in position for firing. The trigger locking device 6 ensures that the adjustment wheel 5 for the firing time is locked.

An activator, which may be electric, hydraulic, hydraulic/pneumatic or a wire connection, moves the trigger 3 into engagement with the stop flap 1 of the rifle bolt and thereby releases the spring force forwardly when the firing is performed only when the rifle bolt and the cover are in the locked position.

Because the components are connected with the trigger parts in the rifle bolt, the components are brought out of position and out of reach for the transmission parts when the cover for loading is open, thereby preventing the weapon from firing in this configuration.

With the adjustment wheel 5 or a corresponding screw, the firing time of the weapon is adjusted to ensure the correct firing position. The adjustment wheel 5 is locked in position by trigger latch 6 or another device abutting and locking the engagement with corresponding locking grooves in the adjustment wheel 5 and the locking device 6 for the trigger by the spring force of the individual parts against each other.

The weapon is further prevented from firing when the stop flap 1 and the trigger 3 are locked together in a position beyond the extent of the latching of the rifle bolt as trigger 3 is constructed and arranged such that the trigger movement will lock this into engagement with the stop flap 1 as long as forces are transmitted to the trigger arm 7 and the trigger 3.

Thus the several aforementioned objects and advantages are most effectively attained Although preferred embodiments of the invention have been disclosed and described in detail herein, it should be understood that this invention is in no sense limited thereby and its scope is to be determined by that of the appended claims.

What is claimed is:

1. A device for a weapon for firing bursts of shots, the device locking and latching the rifle bolt in a rear position to avoid heat distribution from the chamber or barrel to powder and explosives in a booster charge or an explosive projectile, and to prevent firing by emptying or handling the weapon, CHARACTERIZED IN an activator moving a trigger (3) in engagement with a stop flap (1) of a rifle bolt, thereby releasing a spring force of the rifle bolt forwardly wherein firing is performed only when the rifle bolt and a cover are in a locked position.

2. A device according to claim 1, wherein the weapon is prevented from firing by components operating trigger parts in the rifle bolt being brought out of position from the transfer parts when the cover is opened for loading.

3. A device according to claim 1 further including an adjustment wheel (5) or a screw for adjustment of timing of firing of the weapon, said adjustment wheel or screw locks a latch (6) for the trigger in a position wherein the adjustment wheel or screw abut and are locked in engagement with their locking grooves by the individual spring forces of the parts, towards each other.

4. A device according to claim 1 wherein the weapon is secured against firing by a stop flap (1) and the trigger (3) being locked together in a position free of engagement with the rifle bolt as the trigger (3) is constructed and arranged that movement of said trigger locks the trigger (3) in engagement with the stop flap (a) as long as forces are supplied to the trigger arm (7) and the trigger (3).

* * * * *